US010081579B2

(12) United States Patent
Cooper et al.

(10) Patent No.: US 10,081,579 B2
(45) Date of Patent: Sep. 25, 2018

(54) EXPLOSIVE COMPOSITION

(71) Applicant: Orica International Pte Ltd, Singapore (SG)

(72) Inventors: John Cooper, Ayr (GB); Ian John Kirby, Ayr (GB); Richard Goodridge, Parker, CO (US); Vladimir Sujansky, East Burwood (AU); Simon James Ferguson, Redhead (AU)

(73) Assignee: ORICA INTERNATIONAL PTE LTD, Singapore (SG)

( * ) Notice: Subject to any disclaimer, the term of this patent is extended or adjusted under 35 U.S.C. 154(b) by 0 days.

(21) Appl. No.: 14/365,900

(22) PCT Filed: Dec. 13, 2012

(86) PCT No.: PCT/AU2012/001527

§ 371 (c)(1),
(2) Date: Jun. 16, 2014

(87) PCT Pub. No.: WO2013/086572

PCT Pub. Date: Jun. 20, 2013

(65) Prior Publication Data

US 2014/0352567 A1 Dec. 4, 2014

(30) Foreign Application Priority Data

Dec. 16, 2011 (AU) ..... 2011905262

(51) Int. Cl.
*C06B 45/00* (2006.01)
*C06B 23/00* (2006.01)
(Continued)

(52) U.S. Cl.
CPC ..... *C06B 45/00* (2013.01); *C06B 23/003* (2013.01); *C06B 23/004* (2013.01); *C06B 31/28* (2013.01); *C06B 31/285* (2013.01); *F42D 1/00* (2013.01)

(58) Field of Classification Search
CPC ..... C06B 45/00; C06B 31/28; C06B 23/04
See application file for complete search history.

(56) References Cited

U.S. PATENT DOCUMENTS 3,774,496 A 11/1973 Roach
3,797,392 A 3/1974 Eckels
(Continued)

FOREIGN PATENT DOCUMENTS

CN 103193557 7/2013
EP 0136081 B1 11/1987
(Continued)

OTHER PUBLICATIONS

Patent Examination Report No. 1 for Australian Application No. 2012350355, dated Aug. 4, 2015, 2 pages.
(Continued)

*Primary Examiner* — Aileen Baker Felton

(57) ABSTRACT

An explosive composition comprising a liquid energetic material and sensitizing voids, wherein the sensitizing voids are present in the liquid energetic material with a non-random distribution, wherein the liquid energetic material comprises (a) regions in which the sensitizing voids are sufficiently concentrated to render those regions detonable and (b) regions in which the sensitizing voids are not so concentrated and wherein the explosive composition does not contain ammonium nitrate prill.

24 Claims, 5 Drawing Sheets

(a) top, (b) middle and (c) bottom.

(51) Int. Cl.
*C06B 31/28* (2006.01)
*F42D 1/00* (2006.01)

(56) References Cited

U.S. PATENT DOCUMENTS

| | | | | |
|---|---|---|---|---|
| 4,104,092 | A | 8/1978 | Mullay | |
| 4,326,900 | A | 4/1982 | Hattori et al. | |
| 4,554,032 | A | 11/1985 | Hattori et al. | |
| 4,614,146 | A | 9/1986 | Ross et al. | |
| 4,757,764 | A | 7/1988 | Thureson et al. | |
| 5,099,763 | A * | 3/1992 | Coursen | C06B 45/00 102/313 |
| 5,470,407 | A | 11/1995 | Griffith et al. | |
| 5,524,523 | A | 6/1996 | Lübbe et al. | |
| 5,584,222 | A | 12/1996 | Engsbråten et al. | |
| 5,712,440 | A | 1/1998 | Eagar et al. | |
| 5,783,768 | A | 7/1998 | Jacobson | |
| 6,125,761 | A | 10/2000 | Smith, Jr. et al. | |
| 6,165,297 | A | 12/2000 | Smith et al. | |
| 6,173,662 | B1 | 1/2001 | Donovan | |
| 6,397,719 | B1 | 6/2002 | Vestre | |
| 6,537,399 | B2 | 3/2003 | Gomez De Segura et al. | |
| 6,669,753 | B1 | 12/2003 | Chambers et al. | |
| 6,877,432 | B2 | 4/2005 | Thomson et al. | |
| 6,982,015 | B2 | 1/2006 | Atkinson et al. | |
| 7,370,565 | B2 | 5/2008 | Pressley et al. | |
| 7,971,534 | B2 | 7/2011 | Waldock | |
| 8,230,937 | B1 | 7/2012 | Asay et al. | |
| 8,708,202 | B2 | 4/2014 | Robertson et al. | |
| 8,820,242 | B2 | 9/2014 | Alexander | |
| 9,175,933 | B2 | 11/2015 | Patel | |
| 9,207,055 | B2 | 12/2015 | Halander et al. | |
| 9,267,777 | B2 | 2/2016 | Waldock | |
| 9,415,360 | B2 | 8/2016 | Xue | |
| 9,435,625 | B2 | 9/2016 | Halander et al. | |
| 2003/0006319 | A1 | 1/2003 | Silverstein et al. | |
| 2003/0029346 | A1 | 2/2003 | Atkinson et al. | |
| 2015/0218061 | A1 | 8/2015 | Cooper et al. | |
| 2016/0145165 | A1 | 5/2016 | Zank et al. | |
| 2016/0146587 | A1 | 5/2016 | Zank et al. | |

FOREIGN PATENT DOCUMENTS

| | | | |
|---|---|---|---|
| EP | 0142271 | B1 | 2/1988 |
| EP | 1571136 | A2 | 9/2005 |
| GB | 2218701 | A | 11/1989 |
| GB | 2338429 | A | 12/1999 |
| NL | 6918158 | A | 6/1971 |
| WO | WO 97/24298 | A1 | 7/1997 |
| WO | WO 97/30955 | A1 | 8/1997 |
| WO | WO 2002/024608 | A1 | 3/2002 |
| WO | WO 2009/092137 | | 7/2009 |
| WO | WO 2013/086572 | | 6/2013 |

OTHER PUBLICATIONS

Supplementary European Search Report for European Application No. 12857029.8, dated Apr. 17, 2015, 12 pages.
Office Action for European Application No. 12857029.8, dated Feb. 20, 2017, 6 pages.
International Search Report and Written Opinion for International Application No. PCT/AU2012/001527, dated Feb. 7, 2013, 8 pages.
Maron, S. H. et al., "Fundamentals of Physical Chemistry," Editorial Limusa S.A. Mexico, 1978, p. 469.
3M Microspheres, Technical Data Sheet, K Series, S Series Energy and advanced materials division, 2007.
Wang, X., "Explosive emulsion," Metallurgical Industry Press, 1994, p. 6.

* cited by examiner

Figure 1 (a) top, (b) middle and (c) bottom.

EXPLOSIVE COMPOSITION

CROSS-REFERENCES TO RELATED APPLICATIONS

This application is a U.S. national phase application of International PCT Patent Application No. PCT/AU2012/001527, which was filed on Dec. 13, 2012, which claims priority to Australian Patent Application No. 2011905262, filed Dec. 16, 2011. These applications are incorporated herein by reference in their entireties.

TECHNICAL FIELD

The present invention relates to explosive compositions, in particular to explosive compositions that are tailored to provide desired blasting properties, and to a method of blasting using explosive compositions of the invention. The present invention also relates to the manufacture of such compositions and to their use in blasting operations. The present invention also relates to the design and formulation of explosive compositions that allows the shock and heave energies to be manipulated as required based on intended use in a particular blasting.

BACKGROUND

Detonation energy of commercial explosives can be broadly divided into two forms—shock energy and heave energy. Shock energy fractures and fragments rock. Heave energy moves blasted rock after fracture and fragmentation, generally as a function of gas produced behind the CJ zone during detonation. In general the higher the velocity of detonation (VOD) of an explosive the higher proportion of shock energy of the explosive is likely to exhibit.

Certain mining applications require the use of explosives that exhibit a combination of low shock energy and high heave energy. This allows fragmentation to be controlled (high shock energy produces significant amounts of dust sized fines) and in turn reduces excavation costs. In softer rock and coal mining applications, for example, the use of explosives that provide a relatively high proportion of heave energy can lead to significant savings downstream for the mine operation because collection of blasted rock then becomes easier. In quarry applications, fragmentation control and reduction of fines is also very attractive.

Current commercial explosives offer a range of shock and heave energies. For example, ANFO (ammonium nitrate/fuel oil) tends to provide low shock energy and high heave energy. In fact, ANFO with all of its ammonium nitrate present as prill exhibits what is conventionally believed to be an excellent combination of shock (fragmentation) and heave properties for many rock blasting and collection situations. In contrast, (ammonium nitrate) emulsion explosives tend to provide high shock energy and low heave energy. It is well known that such emulsion explosives tend to have relatively high velocities of detonation and correspondingly high pressure in the chemical reaction zone. This results in a high shock explosive that is well suited to fragmenting rock, but that has relatively low heave energy to move fragmented rock.

In practice, materials that modify explosive characteristics, such as ammonium nitrate (AN) prill are conventionally added to emulsion explosives to enhance their overall heave properties. Prills are understood to contribute to a late burn in the detonation post CJ zone and this manifests itself as heave energy rather than shock energy.

The explosive properties of prill-containing explosive compositions are closely related to the explosive characteristics of the prill itself and, in turn, the explosive characteristics are influenced by factors including the physical features, internal structures and chemical composition of the prill. However, such factors may vary within a wide range depending on such things as the manufacturing technology used to produce the prill, the type and/or content of additives (and/or contaminants) present in the prill, the manner in which the prill is stored and/or transported, and the context of use of the explosive, including the degree of confinement and environmental factors, such as temperature and humidity. As a result, the detonation performance (including the energy release characteristics) of conventional prill-containing explosives tends to be highly variable. Explosive formulations with a high concentration of prill are also very difficult to pump into a blasthole.

A further consideration in relation to the use of ANFO and AN prill-containing emulsion explosives is the cost of manufacture of AN prill. AN prill manufacturing towers represent a significant fraction of capital expenditure associated with an ammonium nitrate production facility. Prilling is also a highly energy intensive process that adds significantly to the carbon footprint associated with these type of explosives.

Against this background it would be desirable to provide an explosive for commercial blasting operations that does not require the use of ammonium nitrate prill and that therefore does not suffer the potential problems associated with the use of prill, but that can achieve at least comparable rock blasting performance as currently used ANFO and AN prill-containing explosives. The present invention seeks to provide an explosive composition that exhibits the desirable features of conventional ANFO and AN prill-containing explosives in terms of detonation energy balance as between shock and heave energies, but that is free of the practical (and economic) constraints associated with the use of such prill-containing conventional explosives.

SUMMARY OF THE INVENTION

In accordance with a first embodiment of the invention there is provided an explosive composition comprising a liquid energetic material and sensitizing voids, wherein the sensitizing voids are present in the liquid energetic material with a non-random distribution; and wherein the liquid energetic material comprises (a) regions in which the sensitizing voids are sufficiently concentrated to render those regions detonable and (b) regions in which the sensitizing voids are not so concentrated, wherein the explosive composition does not contain ammonium nitrate prill.

The explosive composition of the present invention is defined with reference to its internal structure. The liquid energetic material comprising (a) regions in which the sensitizing voids are sufficiently concentrated to render those regions detonable and (b) regions in which the sensitizing voids are not so concentrated, rendering different detonation characteristics. Thus, a charge made up (entirely) of liquid energetic material in which the sensitizing voids are sufficiently concentrated to render the liquid energetic material detonable will have different detonation characteristics when compared with a charge made up (entirely) of liquid energetic material in which the sensitizing voids are not so concentrated. The (regions of) liquid energetic material having lower concentration of sensitizing voids (i.e. those regions "in which the sensitizing voids are not so concentrated" may be per se detonable but with reduced detonation sensitivity when compared with (those regions of) liquid energetic material including higher concentration of sensitizing voids. Alternatively, (the regions of) liquid energetic material having lower concentration of sensitizing voids may be per se non-detonable.

Herein differences in detonation sensitivity relate to the intrinsic sensitivity of the individual regions, and also concentration of the sensitizing voids present within the regions, of liquid energetic material. It is generally accepted that the sensitivity of an energetic material to shock wave initiation is governed by the presence of the sensitizing voids. Shock-induced void collapse due to application of a shock wave is a typical mechanism for hot spot formation and subsequent detonation initiation in energetic materials. The generation of the shock induced hotspots, or regions of localized energy release, are crucial processes in shock initiation of energetic materials. The effectiveness of the shock initiation further depends on the amplitude and duration of the shock wave.

It is to be appreciated that the explosive composition of this first embodiment is distinguished from conventional explosive compositions that are formulated by blending sensitizing voids with a liquid energetic material to provide a sensitized explosive product. In that case the voids will be distributed in the liquid energetic material with a random distribution (no amount of mixing will result in a uniform (non-random) spaced distribution of voids). With this random arrangement of voids it may be possible to identify regions in which voids are present in greater concentrations than in others, but the void distribution is nevertheless random in character and there is no structural or systematic consistency within the energetic material with respect to void distribution.

This is to be contrasted with the present invention in which the voids are present with a non-random distribution to provide regions that are void rich and regions that are void deficient. In accordance with this aspect of the invention the voids are present in the liquid energetic material as clusters, and in this respect the explosive compositions of the invention have some structural and systematic consistency with respect to the organization of the voids. In the context of the present invention the term "clusters" is intended to denote a deliberate, grouped arrangement of voids. This arrangement is non-random in character and is not arbitrary in nature.

In relation to this first embodiment of the invention it will be appreciated that regions of liquid energetic material having a high concentration of voids, i.e. including clusters of voids, will per se have different detonation characteristics form regions which have a lower concentration of voids, or no voids at all. It is a requirement of the invention that the explosive composition includes regions in which the sensitizing voids are sufficiently concentrated to render those regions detonable, and this means that those regions would be per se detonable. In other words an explosive composition having a bulk structure corresponding to that of these regions would be detonable in its own right. As voidage influences detonation characteristics, it follows that those regions in the explosive compositions of the invention that have a lower concentration of voids will per se exhibit different detonation characteristics from those regions in which the voids are more highly concentrated. In accordance with the invention it has been found that providing in a single formulation regions of liquid energetic material that per se have different detonation characteristics allows the bulk detonation characteristics of the explosive composition to be influenced and controlled.

In accordance with a second embodiment of the invention regions having different detonation characteristics due to void concentrations can be provided by the use of distinct liquid energetic materials that are sensitized to different extents and that are combined to form an explosive composition. In this embodiment the explosive composition comprises regions of a first liquid energetic material and regions of a second liquid energetic material, wherein the first liquid energetic material is sensitized with sufficient sensitizing voids to render it detonable and wherein the second energetic liquid has different detonation characteristics from the sensitized first liquid energetic material. The (base) liquid energetic materials may be the same or different, although typically the same liquid energetic material is used. When different they will have different physical and chemical properties, such as density and composition.

In embodiments of the invention the explosive compositions of the present invention do not need to rely on ammonium nitrate prill or like material to modify the blasting properties of the explosive composition. Rather, the blasting properties of the explosive composition are directly attributable to the individual regions (and possibly to the liquid energetic material used in those regions where multiple energetic liquids are employed) from which the composition is made up. In accordance with the present invention this approach allows explosive compositions to be formulated that have energy release characteristics (in terms of shock and heave energies) that are at least comparable to conventional prill-containing explosive formulations.

In an embodiment the explosive compositions of the invention do not need to contain any solid oxidiser components or fuels, such as prill, and this means that they can be pumped with relative ease. Thus, related to the first embodiment of the invention, the invention provides an explosive composition consisting of, or consisting essentially of, a liquid energetic material and sensitizing voids, wherein the sensitizing voids are provided in the liquid energetic material with a non-random distribution, and wherein the liquid energetic material comprises (a) regions in which the sensitizing voids are sufficiently concentrated to render those regions detonable and (b) regions in which the sensitizing voids are not so concentrated.

Related to the second embodiment of the invention, the explosive composition may consist of, or consist essentially of, regions of a first liquid energetic material and regions of a second liquid energetic material, wherein the first liquid energetic material is sensitized with sufficient sensitizing voids to render it detonable and wherein the second energetic liquid has different detonation characteristics from the sensitized first liquid energetic material.

In these embodiments the expressions "consisting of" and variations thereof are intended to mean that the explosive composition contains the stated components and nothing else. The expressions "consisting essentially of" and variations thereof are intended to mean that the explosive composition must contain the stated components but that other components may be present provided that these components do not materially affect the properties and performance of the explosive composition.

The present invention also provides a method of producing an explosive composition, the method comprising providing sensitizing voids in a liquid energetic material, wherein the sensitizing voids are provided in the liquid energetic material with a non-random distribution, and such that the liquid energetic material comprises (or consists of or consists essentially of) (a) regions in which the sensitizing voids are sufficiently concentrated to render those regions detonable and (b) regions in which the sensitizing voids are not so concentrated.

Consistent with the second embodiment of the invention, there is also provided a method of producing an explosive composition, the method comprising (or consisting of or consisting essentially of) combining together a first liquid energetic material and a second liquid energetic material to provide regions of the first liquid energetic materials and regions of the second liquid energetic material, wherein the first liquid energetic material is sensitized with sufficient sensitizing voids to render it detonable and wherein the second energetic liquid has different detonation characteristics from the sensitized first liquid energetic material.

As another variant, the present invention enables explosive compositions to be formulated with reduced quantities of ammonium nitrate prill when compared with conventional prill-containing explosives, whilst achieving the same detonation energy balance as such conventional explosives. Accordingly, the present invention also provides an explosive composition comprising a liquid energetic material and sensitizing voids, wherein the sensitizing voids are present in the liquid energetic material with a non-random distribution, wherein the liquid energetic material comprises (a) regions in which the sensitizing voids are sufficiently concentrated to render those regions detonable and (b) regions in which the sensitizing voids are not so concentrated, and wherein the composition further comprises no more than 25 weight %, preferably no more than 15 weight % and, most preferably, no more than 10 weight %, of solid ammonium nitrate (as AN prill or ANFO) based on the total weight of composition. This represent somewhere between 20 to 50% of the amount of solid AN or ANFO used in conventional explosive compositions.

In this embodiment the solid (prill) component should generally be provided in higher density regions of the liquid energetic material making up the explosive composition, i.e. those regions that do not include sensitizing voids or a reduced level of sensitizing voids when compared with other regions that (are designed to) have a, higher concentration of sensitizing voids. For example, this embodiment may be implemented by premixing solid AN prill or ANFO with an unsensitized liquid energetic material prior to blending the unsensitized liquid energetic material with a sensitized liquid energetic material consistent with the general principles underlying the invention.

In this embodiment the detonation characteristics of the explosive composition can be tailored in accordance with the underlying principles of the invention by controlling how voids are placed and concentrated within the liquid energetic material so it is possible to achieve an intended detonation energy outcome without needing to include as much prill as one would do normally. The inclusion of relatively small amounts of AN prill may also be applied to influence detonation characteristics, however. Some applications may benefit from the generation of additional energy from decomposition of the solid component or/and utilizing its free oxygen in further reactions with available fuels. Inclusion of the solid component in void-free regions of liquid energetic material may lead to an increase in the total energy of the composition through reduction of the water content in those regions of liquid energetic material.

The present invention also provides a method of varying the energy release characteristics of a first liquid energetic material sensitized with sufficient sensitizing voids to render it detonable which comprises formulating an explosive composition comprising (or consisting of or consisting essentially of) regions of the first liquid energetic material and regions of a second liquid energetic material, wherein the second energetic liquid has different detonation characteristics from the sensitized first liquid energetic material.

The present invention also provides a method of (commercial) blasting using an explosive composition in accordance with the present invention. The explosive composition is used in exactly the same manner as conventional explosive compositions. The explosive compositions of the invention are intended to be detonated using conventional initiating systems, for example using a detonator and a booster and/or primer.

The context of use of the explosive composition of the present invention will depend upon the blasting properties of the composition, especially with regard to the heave and shock energies of the composition. It will be appreciated however that it is envisaged that, in view of their desirable energy release characteristics, the present invention will provide explosive compositions that can be used instead of conventional ANFO or AN prill-containing formulations. Explosive compositions of the invention may have particular utility in mining and quarrying applications.

Herein the term "liquid energetic material" is intended to mean a liquid explosive that has stored chemical energy that can be released when the material is detonated. Typically, a liquid energetic material would require some form of sensitization to render it per se detonable. Thus, the term excludes materials that are inherently benign and that are non-detonable even if sensitized, such as water. It should be noted however that this does not mean that each liquid energetic material in the explosive compositions of the invention are in fact sensitized. Indeed, in embodiments of the invention, one of the liquid energetic materials is sensitized and another liquid energetic material is not sensitized at all. That said, in other embodiments one of the liquid energetic materials is sensitized and another liquid energetic material is sensitized to a lesser extent.

The energetic materials used in the invention are in liquid form, and here specific mention may be made of explosive emulsions, water gels and slurries. Such emulsions, water gels and slurries are well known in the art in terms of components used and formulation.

In the context of the present invention, the term "explosive composition" means a composition that is detonable per se by conventional initiation means at the charge diameter being employed.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

BRIEF DISCUSSION OF FIGURES

DETAILED DISCUSSION OF THE INVENTION

Figure 1:
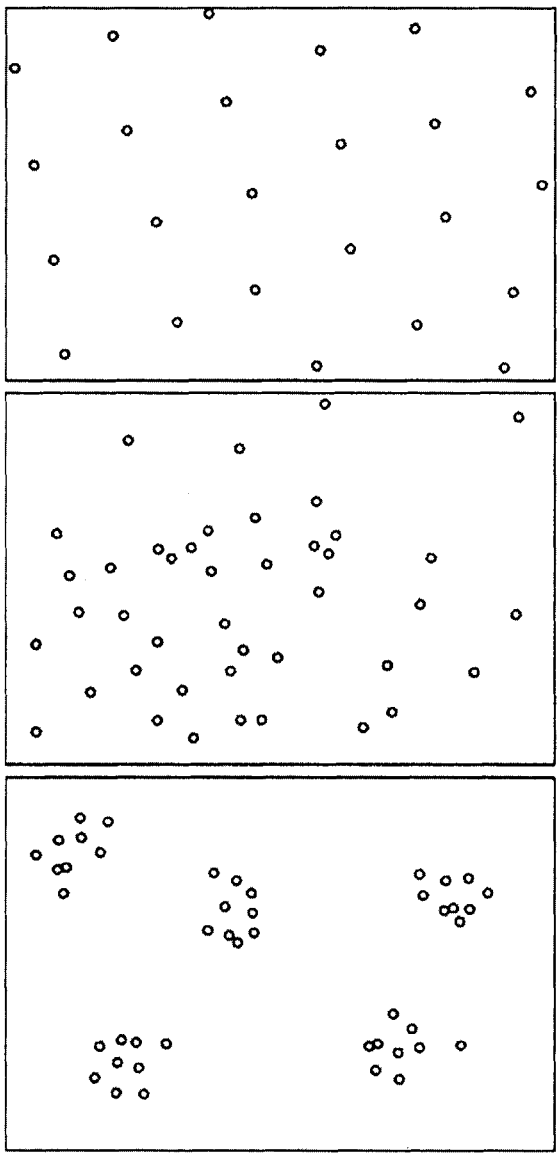
FIG. 1 is a schematic showing possible arrangements of voids in a liquid energetic material.

In accordance with the present invention it has been found that the detonation characteristics of a void sensitized liquid energetic material can be controlled by controlling how the voids are arranged within the liquid energetic material. In particular it has been found that the ratio of heave energy to shock energy delivered by detonation of liquid energetic materials sensitized with voids can be significantly increased, compared with existing void sensitized "all liquid" energetic materials, by controlling how the voids are distributed with respect to each other. It is also possible to achieve a high heave to shock energy ratio whilst maintaining higher total energy densities than is available from conventional "all liquid" systems.

Prior to the present invention much has been reported on the use of different types of voids and voidage levels, but there is not believed to have been any systematic investigation of the effect of relative void spatial distribution. Existing void sensitized liquid energetic materials have a similar (random) spatial distribution of the voids with respect to each other. Only by using voids which provide fuel, such as expanded polystyrene, and with void diameters of 500 μm or more, have higher heave energies been achieved. With the present invention unconventionally high ratios of heave to shock energies with voids sizes from 20 μm to 5 mm can be achieved, and high total energies similar to solid AN prill-containing formulations, can be achieved.

Without wishing to be bound by theory, the mechanisms involved when an explosive composition of the invention is initiated are believed to be as follows. Distribution of the explosive energy between shock and heave is governed by the speed of reactions within the individual sensitized and unsensitized regions. The chemical reactions within the hot spots are fast and exothermic and thus enable detonations by large number of interconnected, small thermal explosions. The number and size of the hot spots controls the sensitivity and speed of detonation reactions within the sensitized region. In this way the sensitized region contributes to the magnitude of the shock energy output. The insufficient number or total absence of hot spots leads to relatively slow reactions (burning) in unsensitized region of energetic liquid. The grain burning mechanism controls the rate of energy release within unsensitized regions of the energetic material. The process hence determines output of the heave energy. Importantly, in accordance with the invention, the energy release characteristics of the explosive composition can be controlled and tailored by varying the void distribution, void volume, the combination of liquid energetic components used and/or the arrangement of the liquid energetic components within the bulk of the explosive composition. In turn, this enables the detonation properties of the explosive composition to be tailored to particular rock/ground types and to particular mining applications.

The present invention may be of particular interest when applied to the use of emulsion explosives as liquid energetic materials. Emulsion-based bulk explosives do not have blasting characteristics, such as velocity of detonation (VOD), equivalent to conventional ANFO or AN prill-containing explosives. However, emulsion explosives do have desirable properties in terms of water resistance and the ability to be pumped. Accordingly, emulsion-based explosive compositions of the present invention may be used as an alternative to ANFO and AN-containing products. This will allow such conventional explosives compositions to be replaced with products that are emulsion-only based. Accordingly, the present invention also provides the use of an emulsion explosive composition in accordance with the present invention in a blasting operation as an alternative to ANFO or AN-containing product.

In this context the emulsion explosives are typically water-in-oil emulsions comprising a discontinuous oxidizer salt solution (such as ammonium nitrate) dispersed in a continuous fuel phase and stabilized with a suitable emulsifier. Sensitization is achieved in conventional manner by inclusion of "voids" such as gas bubbles or micro-balloons, e.g. glass or polystyrene micro-balloons. This will influence the density of the emulsion.

Central to the present invention is the arrangement with which voids are distributed within a liquid energetic material. Thus, the explosive compositions of the present invention include regions that are void rich (i.e. relatively concentrated) and regions that are void deficient (i.e. not so concentrated), these regions per se having different detonation characteristics. Combining such regions results in a bulk product having novel detonation characteristics as compared to the detonation characteristics of the individual regions that are present. As will become apparent there is great scope for modifying the internal structure of the bulk product based on its constituent components/regions and in turn this advantageously provides great scope for tailoring the explosive characteristics of the product.

In accordance with the present invention it may be possible to achieve one or more of the following practical benefits otherwise not attainable with a homogeneous emulsion-only void sensitized explosive compositions:

- Excellent combination of heave properties and fragmentation.
- Steady low VOD during detonation.
- Ability to adjust/match detonation energy/properties to rock properties.
- Control of energy release rate by proportion of different components in the explosive composition. This enables the invention to deliver high heave or high shock performance to match customer specific applications.

When compared with solid AN-containing formulations, explosive compositions of the invention that are prill-free offer the following benefits:

- Water resistance.
- Liquid explosives enable pumping at higher flow rates and lower pumping pressures leading to faster loading of water filled holes.

In the first embodiment of the invention the explosive composition comprises a liquid energetic material and sensitizing voids, wherein the sensitizing voids are present in the liquid energetic material with a non-random distribution, and wherein the liquid energetic material comprises (a) regions in which the sensitizing voids are sufficiently concentrated to render those regions detonable and (b) regions in which the sensitizing voids are not so concentrated. In this embodiment the internal structure of the explosive composition is characterized by the distribution of voids, the volume ratio of the various regions and the arrangement of the regions. The void distribution may broadly be understood with reference to FIG. 1. This figure shows three types of void distributions in a liquid energetic material (matrix).

FIG. 1(*a*) shows a uniform spaced distribution of voids as would arise with ideal mixing of voids in a liquid energetic material. It will be appreciated that this is arrangement is ideal/hypothetical and would not be found in real systems.

FIG. 1(*b*) shows a random arrangement of voids as would arise in practice when formulating a conventional explosive composition by mixing of voids into a liquid energetic material. It might be possible to identify regions that are void rich and different regions that are void deficient but the arrangement is nevertheless random and nothing deliberate has been done at achieve regions having these structural features in terms of void distribution.

FIG. 1(*c*) on the other hand shows an example of clusters of voids distributed throughout a matrix of liquid energetic material, as per the first embodiment of the invention. This arrangement is deliberate rather than arbitrary, and there is some structural and systematic consistency. FIG. 1(*c*) suggests that the regions of void concentration are approximately the same size and occur with an even distribution, but this is not essential. Furthermore, FIG. 1(*c*) shows the use of a single liquid energetic material (matrix). However, this is not essential and the regions differing in void concentration may be achieved by the use of different liquid energetic materials sensitized to different extents.

In another (second) embodiment of the invention the explosive composition comprises regions of a first liquid energetic material and regions of a second liquid energetic material, wherein the first liquid energetic material is sensitized with sufficient sensitizing voids to render it detonable and wherein the second energetic liquid has different detonation characteristics from the sensitized first liquid energetic material. It will be appreciated that this embodiment is related to the first embodiment in that in the second embodiment individual liquid energetic materials are combined to provide the regions having the requisite void concentrations referred to in the first embodiment.

With respect to the second embodiment of the invention, the (internal) structure of the explosive composition is characterized by the volume ratio of each component (liquid energetic material) and the structural arrangement/distribution of the components relative to each other. In the explosive compositions of this embodiment the two components are generally present as (discrete) regions.

In accordance with this embodiment the first and second liquid energetic materials have different detonation characteristics, such as VOD and detonation sensitivity. In one embodiment the first and second liquid energetic materials (e.g. emulsion explosives) are derived from the same base source (e.g. emulsion). For example, in this case, the first emulsion may be produced by void sensitizing a base emulsion, thereby reducing its density, and the second emulsion may be the base emulsion itself. In this case the explosive composition will include discrete regions of basic (unsensitized) emulsion and regions of the sensitized emulsion. The density and blasting characteristics of the resultant explosive composition will be determined and influenced by the individual components from which the composition is formed.

Advantageously, in this second embodiment of the invention the make up and structural characteristics of the explosive composition may be varied in a number of ways and this may provide significant flexibility in terms of achieving particular blast outcomes that have otherwise not been achievable using conventional emulsion-based void sensitized explosive products. Thus, in the embodiment described, where an unsensitized emulsion is provided in combination with a sensitized emulsion, numerous possibilities exist within the spirit of the present invention. The following are given by way of example. It will be appreciated that combinations of the following variants may be employed.

- The relative proportions of the first and second emulsions may be varied.
- The geometry of the individual regions may be varied. For example, for a given volume of emulsion, the first emulsion may be present as small dispersed droplets/domains/zones separated from one another by intervening regions of the second emulsion. Alternatively, the second emulsion may be present as small dispersed droplets/domains/zones separated from one another by intervening regions of the first composition. As a further alternative, the first and second emulsions may be present as discrete domains/zones arranged as a bi-continuous mixture of the two compositions. In an embodiment of the invention the unsensitized phase may be in the form of globules, sheets, rods or bi-continuous structures, such that the smallest dimension of the unsensitized phase is 3 to 5000, for example 5 to 50 times, times the mean diameter of the sensitizing voids.
- The emulsions may be derived from the same or different "base" emulsion.
- One emulsion may form a discontinuous phase and the other emulsion may form a continuous phase. In the example given above, the unsensitized emulsion may form the matrix and the void sensitized emulsion the discontinuous phase.
- It is essential that one of the emulsions that is used be void sensitized (for detonation using the intended initiating system) but the other emulsion does not need to be non-sensitized. Both emulsions may be void sensitized, although in this case the individual emulsions must nevertheless exhibit different blasting characteristics.
- When both emulsions are void sensitized, each emulsion may be sensitized in a different way. For example, one emulsion may be gassed and the other emulsion include micro-balloons, such as expanded polystyrene. As another example, each emulsion may be sensitized with different sizes of micro-balloons.

It will be appreciated from this that the formulation flexibility associated with the present invention allows the production of explosive compositions that have detonation characteristics, such as VOD, to be substantially different from homogeneous emulsion-only void sensitized explosive products having similar composition in terms of liquid energetic material and void sensitization.

The sensitizing voids may be gas bubbles, glass micro-balloons, plastic micro-balloons, expanded polystyrene beads, or any other conventionally used sensitizing agent. The density of the sensitizing agent is typically below 0.25 g/cc although polystyrene spheres may have a density as low as 0.03-0.05 g/cc, and the voids generally have mean diameters in the range 20 to 2000 μm, for example in the range 40 to 500 μm.

Noting the scope for variation in composition formulation that exists, it would in fact be possible to provide a comprehensive suite of explosive compositions tailored to meet different blasting requirements using only a limited number of base emulsion formulations. In turn this may lead to more streamlined logistics, while at the same time possibly lead to lower formulation and operational costs.

Furthermore, the present invention may render useful products that have previously been thought to be unsuitable in the explosives context. For example, by using ammonium nitrate as melt grade only, a range of previously unacceptable ammonium nitrate sources could be used, leading to lower cost explosives.

The present invention also provides a method of (commercial) blasting using an explosive composition in accordance with the present invention. The explosive compositions of the invention are intended to be detonated using conventional initiating systems, for example comprising a detonator and a booster and/or primer. The present invention may be applied to produce explosive composition that detonate at a steady predetermined velocity, with a minimum VOD of 2000 m/s, for example from 2000-6000 m/s in either a confined bore hole, or under unconfined conditions. It will be appreciated that the VOD of an explosive composition in accordance with the invention will be less than the VOD of the component (or region) of the composition having the highest VOD. It is well known that the amount of shock energy at a given explosive density is proportional to the VOD, and as such, reduction in the VOD results in a decrease in shock energy and corresponding increase in heave energy.

Advantageously, the present invention may be used to provide an emulsion-based explosive composition that matches ANFO or an AN prill based product with respect to density and velocity of detonation. For example, if a commercially available product containing AN prill has a density of 1.2 g/cc, this same density could be achieved by using an explosive composition in accordance with the invention in which a non-sensitized emulsion having a density of 1.32 g/cc is used in combination with a void-sensitized emulsion having a density of 0.8 g/cc at a volume ratio of 78:22. The same density could of course be achieved using different volume proportions of emulsions having different densities. For example, a density of 1.32 g/cc could be achieved using the following combinations of densities and volume ratios for the non-sensitized and sensitized emulsions respectively: 1.32 g/cc and 1.0 g/cc at 67:33; 1.32 g/cc and 0.9 g/cc at 73:27; and 1.32 g/cc and 0.8 g/cc at 78:22. The VOD of each explosive composition will be different, and a target VOD may be achieved by varying the volume ratio and density of the emulsion components whilst maintaining density matching with the prill-containing product. In proceeding in this way it is possible to provide emulsion-based explosive compositions that offer similar blasting performance to prill-based products.

Explosive compositions in accordance with the present invention may be made by blending together a first liquid energetic material and a second liquid energetic material to provide regions of the first liquid energetic materials and regions of the second liquid energetic material, wherein the first liquid energetic material is sensitized with sufficient sensitizing voids to render it detonable and wherein the second energetic liquid has different detonation characteristics from the sensitized first liquid energetic material. Blending of the individual liquid energetic materials may take place during loading into a blasthole but this is not essential and blending may be undertaken in advance provided that delivery into a blasthole does not disrupt the intended structure of the explosive composition. The liquid energetic materials used may be the same or different.

Figure 2:
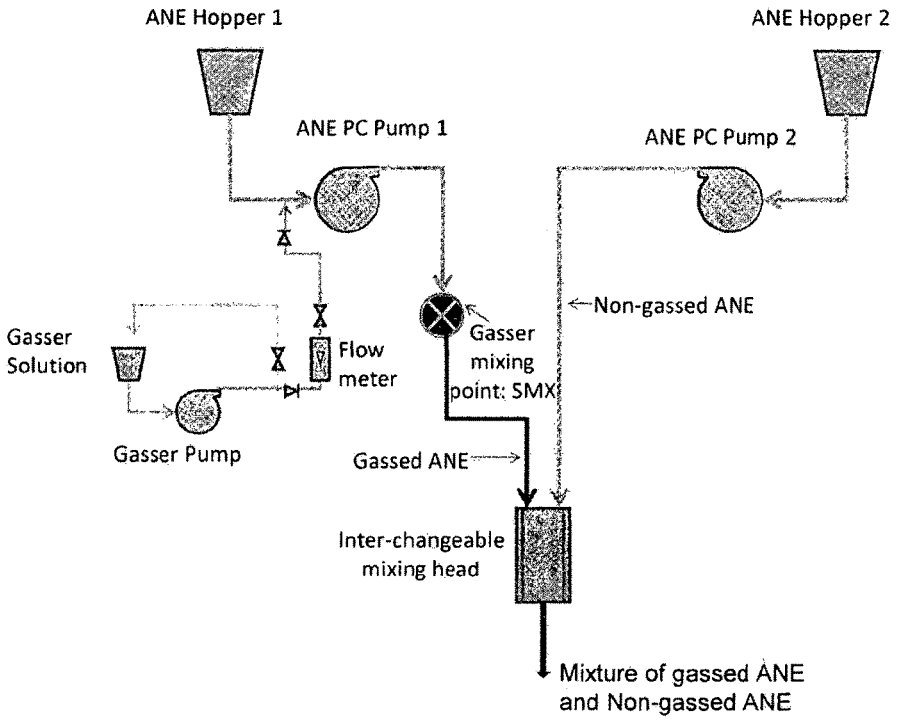
FIG. 2 is a schematic illustrating how a void-sensitized liquid energetic material in accordance with an embodiment of the invention may be produced, as referred to in the examples
Figure 3:
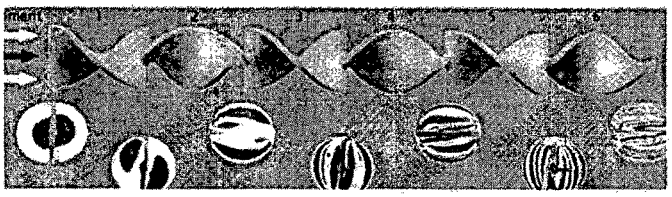
FIG. 3 is a schematic illustrating a mixing element that may be used to produce a void-sensitized liquid energetic material in accordance with an embodiment of the invention.

In an embodiment of the invention an explosive composition may be prepared by mixing of streams of individual components using a static mixer (see FIG. 3 and the discussion below). By this mixing methodology the streams of the individual components are split into sheets that have a mean thickness typically in the range 2 to 20 mm. The characteristics of the sheets can be adjusted by adjusting the mixing methodology, for example by varying the number of mixing elements in the static mixer. The corresponding process diagram is shown in FIG. 2. With reference to that figure the experimental rig comprises two emulsion holding hoppers ANE1 and ANE2. Two progressive cavity (PC) metering pumps PC Pump 1 and PC Pump 2 supply streams of the emulsions into an inter-changeable mixing head. The mass flow of the individual fluid streams is set up by calibration of the metering pumps and cross-checking against the total mass flow via into the inter-changeable mixing head. Blending is done in a continuous manner in the closed pipe of an interchangeable mixing head module.

By way of example, in the fluid stream (1), a void-free ammonium nitrate emulsion (ANE1) is mixed in line with an aqueous solution of sodium nitrite in a gasser mixing point using an arrangement of SMX type static mixers. After completion of the gassing reaction the emulsion stream (1) will have a particular density. The second fluid stream (2) may consist, of a void-free ammonium nitrate emulsion having a higher density than the gassed emulsion stream (1).

The inter-changeable mixing head is comprised of two parts. The first part has two separate inlet channels for the entry of each emulsion stream and a baffle just before the entrance to the first static mixer element to ensure separation of the individual streams in the mixing section. The inter-changeable mixing head is 50 mm diameter and length of 228 mm.

A helical static mixer (having 3 elements; see FIG. 3) was used for layering the void sensitized emulsion into the void-free high density emulsion continuum. Alternating layers of void rich and void free are achieved by repeated division, transposition and recombination of liquid layers around a static mixer. Addition of further static mixer elements (for example No 4, 5& 6) reduces the thickness of the layers produced.

Embodiments of the present invention are illustrated with reference to the following non-limiting examples.

EXAMPLE 1

In the absence of AN prill, bulk emulsion explosives rely on the inclusion of voids for sensitization. In such emulsions the oxidizer salt used is typically ammonium nitrate. When an ammonium nitrate emulsion (ANE) is sensitized with voids, for example by chemical gassing or by using micro-balloon (mb) inclusion, the void size is approximately 20-500 μm in diameter. When voids are used to sensitize such emulsion explosives they reduce the formulation density. However, homogeneous sensitization of emulsions with voids will result in much higher velocity of detonation (VOD) than corresponding formulations of a similar density containing AN prill.

This example details explosive compositions made up of two emulsion components: a non-sensitized ammonium nitrate emulsion (n-ANE) and a sensitized ammonium nitrate emulsion (s-ANE). The non-sensitized emulsion in this example has an ammonium nitrate concentration of approximately 75 wt % and a density of approximately 1.32 g/cc. The s-ANE has an ammonium nitrate concentration of approximately 75 wt % and a variable density from 0.8-1.2 g/cc using either chemical gassing or micro-balloons of a diameter of approximately 40 μm. Various explosive compositions in accordance with the invention can be formed by blending these emulsions and by adjusting the ratio of n-ANE:s-ANE in the formulation. As the ratio is adjusted from the extremes of 100% n-ANE to 100% s-ANE in a 200 mm diameter cardboard cylinder, the VOD ranges from a failure to detonate for the non-sensitized emulsion to over 6000 m/s for 100% s-ANE. However, the ability to isolate discrete regions of s-ANE (or n-ANE) within a bulk charge of n-ANE (or s-ANE) allows a geometric formulation variable to control detonation velocity and blasting characteristics between these extremes.

The method of manufacturing explosive compositions in accordance with the invention is based on blending two liquid energetic materials. The first phase is conventionally sensitized with voids, the second phase with no or very few added voids, the blending being such that the two phases remain largely distinct from each other, and the diameter, sheet thickness, etc. of the distinct phases are typically in the range from 0.2 mm to 100 mm.

Examples of Homogeneous s-ANE Charges

To identify how homogeneous s-ANE would perform without any n-ANE inclusions, a series of control charges were measured for VOD. The control shots contained ammonium nitrate emulsion and plastic Expancel micro-balloons of approximate 40 μm average diameter. The emulsion and micro-balloons were mixed to form a homogeneous blend ranging in density from 0.8 g/cc to 1.2 g/cc based on the amount of micro-balloons used. The VOD results can be seen in Table 1 below. A standard VOD measurement technique was used in which compositions were submitted for a detonation test in various unconfined diameters. Charges were detonated using Pentolite primers that were initiated with a No8 industrial strength detonator. The velocity of detonation (VOD) of the charges was measured by utilising a micro-timer unit and optical fibres.

TABLE 1

| Charge | | |
|---|---|---|
| Name | Density (g/cc) | VOD (km/s) |
| Control 0.8 | 0.8 | 4.5 |
| Control 0.9 | 0.9 | 5.0 |
| Control 1.0 | 1.0 | 5.6 |
| Control 1.1 | 1.1 | 6.0 |
| Control 1.2 | 1.2 | 6.3 |

As the density increased from 0.8 to 1.2 g/cc the VOD increased from 4.5-6.3 km/s. Clearly, the homogeneous sensitization of emulsion with 40 μm diameter voids produces an emulsion explosive of higher velocity of detonation at increasing densities as would be expected.

μm diameter micro-balloons. To do this, regions of non-sensitized emulsion (n-ANE) were introduced into the sensitized emulsion to reduce the bulk. VOD. The non-sensitized ammonium nitrate emulsion has a density of approximately 1.32 g/cc and consequently increases the overall density of the charge upon simple addition. Therefore to compare charges of equal density to the controls, sensitized emulsion (s-ANE) density must be sufficiently low that subsequent to n-ANE inclusion, the overall charge density is that desired.

Figure 4:
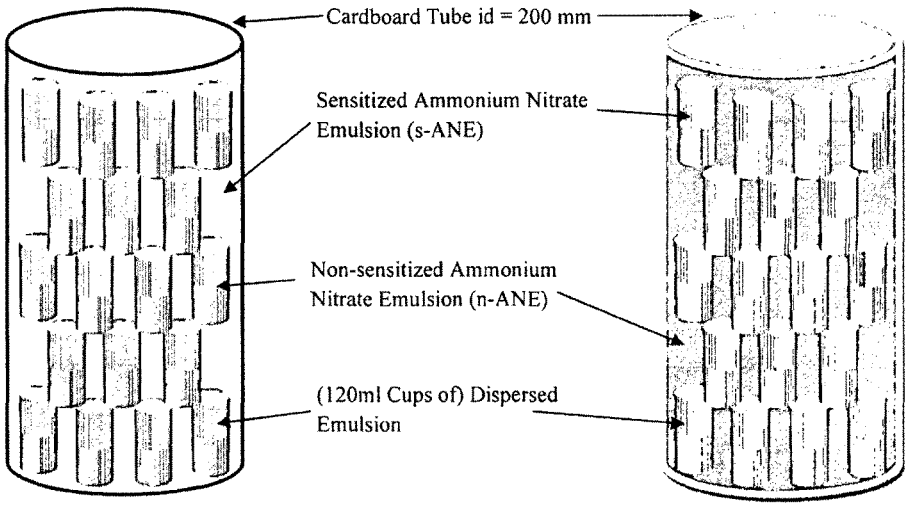
FIG. 4 is a schematic illustrating the distribution of two emulsions in an explosive composition in accordance with an embodiment of the invention.
Figure 5:
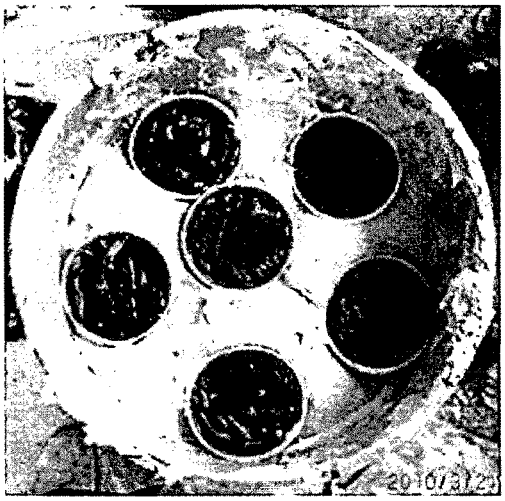
FIG. 5 is a photograph showing an experimental arrangement employed in the examples.

The experimental arrangement is shown schematically in FIG. 4 and by way of photograph (from above) in FIG. 5 where a continuous phase of s-ANE (light colour) has small 120 ml volume cups of n-ANE (dark colour) distributed within the charge. The s-ANE (0.8 g/cc) and the n-ANE (1.32 g/cc) combine to give a mixture of emulsions having a charge density of 1.0 g/cc. Shown in Table 2 below are the results of shots fired at this overall charge density. The first explosive composition is the control (as described above) consisting of only homogeneous phase of ammonium nitrate emulsion and Expancel micro-balloons. This explosive formulation had a VOD of 5.6 km/s.

The charge labeled M1.0,S0.9 in Table 2 below has an overall charge density of 1.0 g/cc, and contains two discrete emulsion phases as per the present invention. A continuous phase of s-ANE (emulsion+micro-balloons, density of 0.9 g/cc) occupying a total of 76.2% of the charge volume, and within this continuous phase are dispersed regions of n-ANE (density of 1.32 g/cc) which occupy the remaining 23.8% of the charge volume. For the purposes of laboratory testing these dispersed regions are in fact 120 ml cardboard cups filled with the n-ANE and placed randomly within the continuous emulsion, thus allowing a physical boundary for isolation of discrete emulsion phases. The combined density of the s-ANE and n-ANE in the charge was 1.0 g/cc. However, the VOD was found to be 4.9 km/s. This is a 13.2% reduction in VOD compared with control 1.0. Indeed, the VOD of charge M1.0,S0.9 is closer to the VOD of the Control 0.9 detailed above in Table 1 which is the same density as the continuous emulsion phase of this charge.

The charge labeled M1.0,S0.8 has an overall charge density of 1.0 g/cc, and a continuous s-ANE of 0.8 g/cc (61.5 vol %). Again, the charge has distributed cups (120 ml each) of n-ANE (38.5 vol %). The VOD of this charge was found to be 4.2 km/s, which is a 25% reduction in VOD compared to control 1.0. Once again the VOD for charge M1.0,S0.8 more closely matches the control shot at the same density as the continuous emulsion phase, i.e. Control 0.8 (Table 1) 4.5 km/s.

TABLE 2

| Charge | | Continuous Emulsion | | | Dispersed Emulsion | | | |
|---|---|---|---|---|---|---|---|---|
| Name | Density (g/cc) | Constituents | density (g/cc) | Vol % | Constituents | density (g/cc) | Vol % | VOD (km/s) |
| Control 1.0 | 1.0 | ANE + mb | 1.0 | 100 | | | | 5.6 |
| M1.0, S0.9 | 1.0 | ANE + mb | 0.9 | 76.2 | ANE | 1.32 | 23.9 | 4.9 |
| M1.0, S0.8 | 1.0 | ANE + mb | 0.8 | 61.4 | ANE | 1.32 | 38.5 | 4.2 |
| HANFO 1.0 | 1.0 | ANE + prill | 1.0 | 100 | | | | 3.6 |
| VG100 | 1.0 | ANE + EPS | 1.0 | 100 | | | | 3.6 |

In accordance with the present invention it is possible to reduce the VOD of these emulsion only explosives for each of the above densities, using the same size voidage, i.e. 40

Also shown in Table 2 is the VOD for heavy ANFO (HANFO 1.0). This heavy ANFO is a homogeneous blend of emulsion (23 wt %) and ANFO (77 wt %), and as such does not have discrete continuous or dispersed emulsion phases as described for the mixtures of emulsion systems in accordance with the present invention. However, similar to the mixtures of emulsion and control 1.0 charges the heavy ANFO, HANFO 1.0, also has an overall charge density of 1.0 g/cc. Heavy ANFO charges rely on porous nitropril for sensitization, and the resulting VOD recorded was found to be 3.6 km/s. The last charge listed in Table 2 gives the results for VG100 which consists of emulsion (99.62 wt %) homogeneously mixed with expanded polystyrene (EPS, 0.38 wt %) of approximately 4 mm diameter for sensitization. As with heavy ANFO, the emulsion and expanded polystyrene are a homogeneous blend throughout the bulk charge and therefore have no discrete dispersed or continuous phases. The VOD for this product was found to be 3.6 km/s.

An important feature of the above charges is that the Control 1.0, M1.0,S0.9 and M1.0,S0.8 charges all have the same total quantity of emulsion and small 40 μm voids in the overall charges. Naturally, having equivalent formulation, they also have the same density, 1.0 g/cc. However, when the internal structure of the explosive charge contains two distinct phases of s-ANE and n-ANE, the VOD of the charge is reduced from the homogeneously mixed analogue such as Control 1.0. One important aspect of the invention is that emulsion only explosives utilizing small 40 μm voids can be formulated to have VOD characteristics of prill and EPS containing products.

Mixture of Emulsion (MOE) Charges of Overall Density 1.1 g/cc

As shown in Table 3 below, all charges have an overall density of 1.1 g/cc. The Control 1.1 was a single phase of s-ANE having a density of 1.1 g/cc. The VOD of this control shot was found to be 6.0 km/s. The charge labeled M1.1, S1.0 has a continuous s-ANE phase of density 1.0 g/cc occupying 68.4% of the total charge volume. The remaining volume of the charge was made up of n-ANE in 120 ml cups distributed throughout the charge. The VOD for charge M1.1,S1.0 was found to be 5.1 km/s. Similarly, charge M1.1, S0.9 was made up of a continuous emulsion phase of s-ANE having a density of 0.9 g/cc occupying 52.4% of the total charge volume and distributed therein 120 ml cups of n-ANE accounting for the remaining 47.6% of total charge volume. Charge M1.1, S0.9 was found to have a VOD of 4.6 km/s.

Charge M1.1,S0.8 was the first charge loaded with n-ANE as the continuous emulsion phase. Therefore, charge M1.1, S0.8 has non-sensitized continuous emulsion phase accounting for 58.8% of the total charge volume. Distributed within this charge was s-ANE having a density of 0.8 g/cc contained in 120 ml cups and accounting for the remaining 41.2 vol % of the total charge. The VOD for charge M1.1,S0.8 was found to be 3.2 km/s. This is a significant reduction to Control 1.1 charge. In addition this low VOD is also lower than heavy ANFO charge HANFO 1.1, thus confirming that mixtures of emulsions in accordance with the invention can achieve low detonation velocities down to levels not previously achievable by small 20-100 μm diameter voids, and comparable to nitropril containing emulsion products.

TABLE 3

| Charge | | Continuous Emulsion | | | Dispersed Emulsion | | | |
|---|---|---|---|---|---|---|---|---|
| Name | Density (g/cc) | Constituents | density (g/cc) | Vol % | Constituents | density (g/cc) | Vol % | VOD (km/s) |
| Control 1.1 | 1.1 | ANE + mb | 1.1 | 100 | | | | 6.0 |
| M1.1, S1.0 | 1.1 | ANE + mb | 1 | 68.4 | ANE | 1.32 | 31.6 | 5.1 |
| M1.1, S0.9 | 1.1 | ANE + mb | 0.9 | 52.4 | ANE | 1.32 | 47.6 | 4.6 |
| M1.1, S0.8 | 1.1 | ANE | 1.32 | 58.8 | ANE + mb | 0.8 | 41.2 | 3.2 |
| HANFO 1.1 | 1.1 | ANE + prill | 1.1 | 100 | | | | 3.8 |

Mixture of Emulsion (MOE) Charges of Overall Density 1.2 g/cc

A series of charges all having an overall density of 1.2 g/cc is detailed in Table 4 below. The control charge was a homogenous blend of ammonium nitrate emulsion and micro-balloons of density 1.2 g/cc, and having a VOD of 6.3 km/s. The remaining charges detailed in Table 4 had a continuous emulsion phase of n-ANE. Charge M1.2,S1.0 had a continuous n-ANE phase accounting for 63.9% of the total charge volume. The s-ANE used had a density of 1.0 g/cc and was distributed within the n-ANE in 120 ml cups occupying remaining 36.1% of the total charge volume. Charge M1.2,S1.0 had a measured VOD of 4.3 km/s.

Charge M1.2,S0.9 included a continuous emulsion phase of n-ANE. This accounted for 73.1 vol % of the total charge. The remaining 26.9 vol % was made up of a s-ANE of density 0.9 g/cc. M1.2,S0.9 had a VOD of only 2.3 km/s. This low VOD could be close to failure as a consequence of such a high volume of n-ANE. Indeed M1.2,S0.8 with 78.0 vol % of n-ANE failed to initiate and over half of the test charge remained after attempted initiation with a 400 g Pentolite booster.

TABLE 4

| Charge | | Continuous Emulsion | | | Dispersed Emulsion | | | |
|---|---|---|---|---|---|---|---|---|
| Name | Density (g/cc) | Constituents | density (g/cc) | Vol % | Constituents | density (g/cc) | Vol % | VOD (km/s) |
| Control 1.2 | 1.2 | ANE + mb | 1.2 | 100 | | | | 6.3 |
| M1.2, S1.0 | 1.2 | ANE | 1.32 | 63.9 | ANE + mb | 1 | 36.1 | 4.3 |
| M1.2, S0.9 | 1.2 | ANE | 1.32 | 73.1 | ANE + mb | 0.9 | 26.9 | 2.3 |
| M1.2, S0.8 | 1.2 | ANE | 1.32 | 78.0 | ANE + mb | 0.8 | 22.0 | FAIL |
| HANFO 1.2 | 1.2 | ANE + prill | 1.2 | 100 | | | | 4.0 |

Although not experimentally measured, there are clearly opportunities to incorporate solid oxidizers, such as AN prill, in one or both of the phases to further fine tune the total energy available and the heave energy/shock energy balance. There are also clearly opportunities to incorporate sub-mm energetic solid fuels, such as aluminum, in one or both of the phases to further significantly enhance the heave energy while achieving exceptionally low shock energies.

EXAMPLE 2

Gassed Emulsion at 1.22 g/cm$^3$

This example serves as a baseline to demonstrate the features of the invention.

Experimental samples were prepared in a specially, designed emulsion experimental rig. The corresponding process diagram is shown in FIG. 2. With reference to that figure the experimental rig comprises two emulsion holding hoppers ANE1 and ANE2. Two metering pumps PC Pump 1 and PC Pump 2 supply streams of the emulsions into ane inter-changeable mixing head. The mass flow of the individual fluid streams is set up by calibration of the metering pumps and cross-checking against the total mass flow via into the inter-changeable mixing head. Blending is done in a continuous manner in the closed pipe of a interchangeable mixing head module.

The inter-changeable mixing head is comprised of two parts. The first part has two separate inlet channels for the entry of each emulsion stream and a baffle just before the entrance to the first static mixer element to ensure separation of the individual streams in the mixing section. The inter-changeable mixing head is 50 mm diameter and length of 228 mm.

A Kenics static mixer (having 3 elements; see FIG. 3) was used for layering the void sensitized emulsion into the void-free high density emulsion. Alternating layers of void rich and void free emulsions are achieved by repeated division, transposition and recombination of liquid layers around a static mixer. In this way, the components of emulsion to be mixed are spread into a large number of layers. A clearly defined and uniform shear field is generated through mixing. Addition of further static mixer elements (for example No 4, 5 & 6) reduces the thickness of the layers produced.

The starting emulsion at a density of 1.32 g/cm$^3$ was delivered by a progressive cavity pump at a rate of 3 kg/min. A 4% mass sodium nitrite solution was injected into the flowing emulsion stream at a rate of 16 g/min by means of a gasser (gear) pump and dispersed in a series of static mixers. 1 m long cardboard tubes with internal diameters ranging from 40 to 180 mm were loaded with emulsion and allowed to gas.

The density change of the gassing emulsion was determined in a plastic cup of known mass and volume. The emulsion was initially filled to the top of the cup and leveled off. As the gassing reaction progressed, the emulsion rose out of the top of the cup and was leveled off periodically and weighed. The density was determined by dividing the mass of emulsion in the cup by the cup volume. Charges were fired once the sample cup reached the target density of 1.22 g/cm$^3$.

Figure 6:
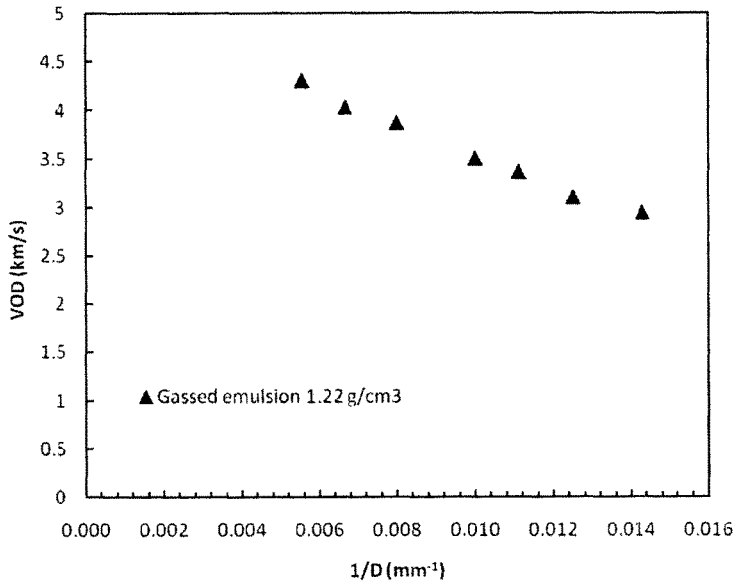
FIGS. 6-8 are graphs illustrating results obtained in the examples.

Charges larger than 70 mm were initiated with a single 400 g Pentex PPP booster, whist smaller charges were initiated with a 150 g Pentex H booster. Velocity of detonation (VOD) was determined using an MREL Handitrap VOD recorder. The VOD ranged from 2.9 km/s for the 70 mm diameter charge to 4.3 km/s at 180 mm. Charges smaller than 70 mm failed to sustain detonation. The results are shown in FIG. 6.

EXAMPLE 3

MOE 25 at 1.22 g/cm$^3$

This example demonstrates the performance of MOE25, i.e. a mixture of emulsion with 25% mass gassed and 75% ungassed emulsion MOE25 was prepared using the apparatus mentioned in Example 2. The base emulsion (density 1.32 g/cm$^3$) was delivered by two progressive cavity pumps, PC1 and PC2. The base emulsion formulation was identical to Example 2 and was the same for both pumps. PC1 pumped ungassed emulsion at a flow rate of 4 kg/min. PC2 delivered emulsion at 1.3 kg/min with gasser (4% $NaNO_2$ solution) injected by a gasser (gear) pump. The emulsion was blended by a static mixer consisting of three helical mixing elements and loaded into cardboard tubes with internal diameters ranging from 70 to 180 mm. The gassed emulsion target density was 0.99 g/cm$^3$ providing an overall density of 1.22 g/cm$^3$ for the mixture of gassed and ungassed emulsion.

Figure 7:
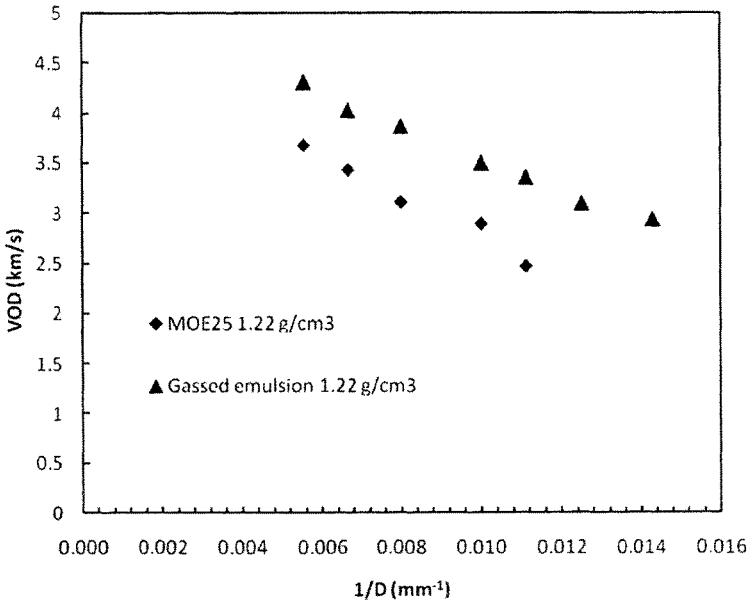

Charges were initiated with a single 400 g Pentex PPP booster with VOD measured with an MREL handitrap VOD recorder. The VOD ranged from 2.5 km/s for the 90 mm charge to 3.7 km/s at 180 mm, a significant reduction relative to the regular gassed emulsion described in Example 2. Charges with diameters smaller than 90 mm failed to sustain detonation. The results are shown in FIG. 7. The reduced VOD of MOE25 indicates that this formulation, comprising a mixture of void rich and void deficient materials, exhibits a lower shock energy and higher heave energy relative to regular gassed emulsion containing randomly dispersed voids at the same overall density.

EXAMPLE 4

MOE 50 at 1.22 g/cm$^3$

This example demonstrates the performance of MOE50, i.e. a mixture of emulsion with 50% mass gassed and 50% ungassed emulsion MOE50 was prepared using the apparatus mentioned in Example 2. The base emulsion (density 1.32 g/cm$^3$) was delivered by two progressive cavity pumps, PC1 and PC2 and was identical to the previous two examples. PC1 pumped ungassed emulsion at a flow rate of 3 kg/min. PC2 delivered emulsion at 3 kg/min with gasser (4% $NaNO_2$ solution) injected by a gasser (gear) pump. The void rich and void free emulsions were blended by a static mixer consisting of three helical mixing elements and loaded into cardboard tubes with internal diameters ranging from 70 to 180 mm. The gassed emulsion target density was 1.13 g/cm$^3$ providing an overall density of 1.22 g/cm$^3$ for the mixture of gassed and ungassed emulsion.

Figure 8:
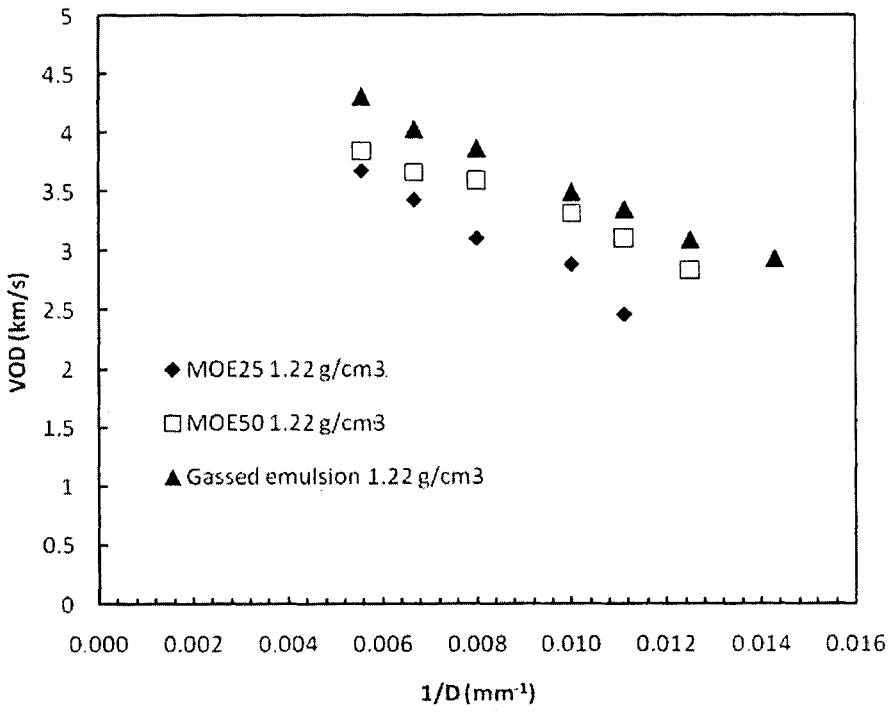

Charges were initiated with a single 400 g Pentex PPP booster with VOD measured with an MREL handitrap VOD recorder. The VOD ranged from 2.8 km/s for the 80 mm charge to 3.9 km/s at 180 mm. Charges with diameters smaller than 80 mm failed to sustain detonation. The results are shown in FIG. 8. VOD results for MOE50 were between those of gassed emulsion and MOE25, indicating intermediate shock and heave energies. This demonstrates that explosive performance can be tailored to suit different blasting applications by adjusting the proportion of void rich and void deficient materials at the same overall density.

The invention claimed is:

1. An explosive composition comprising:

a liquid energetic material; and at least one of gas bubbles or micro-balloons, wherein the at least one of gas bubbles or micro-balloons are present in the liquid energetic material with a non-random distribution, wherein the explosive composition comprises (a) regions in which the at least one of gas bubbles or micro-balloons are sufficiently concentrated to sensitize those regions and render those regions detonable and (b) regions in which the at least one of gas bubbles or micro-balloons are not so concentrated, wherein the explosive composition detonates with a minimum velocity of detonation of 2000 m/s, wherein the explosive composition does not contain any solid oxidizer component.

2. The explosive composition of claim 1, wherein the liquid energetic material is a first liquid energetic material, the explosive composition further comprising a second liquid energetic material, wherein the first liquid energetic material is sensitized with at least one of sufficient gas bubbles or micro-balloons to render it detonable and wherein the second liquid energetic material has different detonation characteristics from the first liquid energetic material.

3. The explosive composition of claim 1, wherein the liquid energetic material is in the form of an emulsion explosive.

4. The explosive composition of claim 1, wherein an average diameter of the at least one of gas bubbles or micro-balloons is 20 μm to 5 mm.

5. The explosive composition of claim 1, wherein a density and a velocity of detonation (VOD) of the explosive composition are consistent with at least one of an ammonium nitrate/fuel oil (ANFO) explosive product or an ammonium nitrate (AN) prill based explosive product.

6. A method of blasting comprising detonating an explosive composition as claimed in claim 1.

7. The explosive composition of claim 1, wherein the regions in which the at least one of gas bubbles or micro-balloons are not so concentrated are non-detonable.

8. The explosive composition of claim 1, wherein the regions in which the at least one of gas bubbles or micro-balloons are not so concentrated are detonable.

9. The explosive composition of claim 1, wherein the non-random distribution of the at least one of gas bubbles or micro-balloons in the liquid energetic material comprises clusters, each cluster comprising a deliberate grouped arrangement of the at least one of gas bubbles or micro-balloons.

10. The explosive composition of claim 2, provided as a single formulation comprising the first liquid energetic material blended with the second liquid energetic material.

11. The explosive composition of claim 1, wherein the liquid energetic material is a first liquid energetic material, the explosive composition further comprising:

a second liquid energetic material having a different detonation sensitivity than the first liquid energetic material, the first liquid energetic material and the second liquid energetic material each being an emulsion such that the explosive composition is a mixture of emulsions.

12. The explosive composition of claim 11, wherein the second explosive composition is unsensitized.

13. The explosive composition of claim 11, wherein the second explosive composition is gas sensitized.

14. The explosive composition of claim 11, wherein the first explosive composition is present as droplets separated from one another by intervening regions of the second explosive composition.

15. The explosive composition of claim 1, wherein the liquid energetic material is an emulsion-only based composition.

16. The explosive composition of claim 15, wherein a VOD and a density of the explosive composition respectively match a VOD and a density of an AN solid component based explosive product.

17. The explosive composition of claim 4, wherein the average diameter of the at least one of gas bubbles or micro-balloons is 20-500 μm.

18. The explosive composition of claim 17, wherein the average diameter of the at least one of gas bubbles or micro-balloons is 20-100 μm.

19. The explosive composition of claim 1, wherein the explosive composition does not contain a solid component comprising ammonium nitrate.

20. The explosive composition of claim 1, wherein the explosive composition detonates with a velocity of detonation of from 2000 to 6000 m/s.

21. An explosive composition comprising:

a liquid energetic material; and at least one of gas bubbles or micro-balloons, wherein the at least one of gas bubbles or micro-balloons are present in the liquid energetic material with a non-random distribution, wherein the liquid energetic material comprises (a) regions in which the at least one of gas bubbles or micro-balloons are sufficiently concentrated to sensitize those regions and render those regions detonable and (b) regions in which the at least one of gas bubbles or micro-balloons are not so concentrated, wherein the explosive composition detonates with a minimum velocity of detonation of 2000 m/s.

22. An explosive composition comprising:

a first liquid energetic material;

at least one of gas bubbles or micro-balloons disposed within and sensitizing the first liquid energetic material; and a second liquid energetic material, the first liquid energetic material, the second liquid energetic material, and the at least one of gas bubbles or micro-balloons provided as a single liquid formulation, the explosive composition having regions of the first liquid energetic material and regions of the second liquid energetic material such that the at least one of gas bubbles or micro-balloons present in the explosive composition with a non-random distribution, wherein the explosive composition comprises (a) regions in which the at least one of gas bubbles or micro-balloons are sufficiently concentrated to sensitize those regions and render those regions detonable and (b) regions in which the at least one of gas bubbles or micro-balloons are not so concentrated.

23. The explosive composition of claim 1, wherein the at least one of gas bubbles or micro-balloons are gas bubbles.

24. The explosive composition of claim 1, wherein the at least one of gas bubbles or micro-balloons are microballoons.

* * * * *